US008503706B2

(12) United States Patent
Ochsenbein et al.

(10) Patent No.: US 8,503,706 B2
(45) Date of Patent: Aug. 6, 2013

(54) HEARING DEVICE WITH USER CONTROL

(75) Inventors: André Lucien Ochsenbein, Wolfhausen (CH); André Simmler, Schindellegi (CH); Urs Zueger, Stäfa (CH); Hans Georg Meier, Uerikon (CH)

(73) Assignee: Phonak AG, Stafa (CH)

( * ) Notice: Subject to any disclaimer, the term of this patent is extended or adjusted under 35 U.S.C. 154(b) by 155 days.

(21) Appl. No.: 12/935,054

(22) PCT Filed: Mar. 28, 2008

(86) PCT No.: PCT/EP2008/053747

§ 371 (c)(1),
(2), (4) Date: Sep. 28, 2010

(87) PCT Pub. No.: WO2009/118047

PCT Pub. Date: Oct. 1, 2009

(65) Prior Publication Data

US 2011/0026747 A1 Feb. 3, 2011

(51) Int. Cl.
*H04R 25/00* (2006.01)

(52) U.S. Cl.
USPC ..... 381/323; 381/322; 381/324

(58) Field of Classification Search
USPC ..... 381/312, 322–324, 327–328, 330
See application file for complete search history.

(56) References Cited

U.S. PATENT DOCUMENTS 5,404,407 A 4/1995 Weis
5,687,242 A 11/1997 Iburg

FOREIGN PATENT DOCUMENTS

EP 1496530 A2 1/2005
WO 2007/001235 A1 6/2005

OTHER PUBLICATIONS

International Search Report for PCT/EP2008/053747 dated Nov. 19, 2008.
Written Opinion for PCT/EP2008/053747 dated Nov. 19, 2008.

*Primary Examiner* — Suhan Ni
(74) *Attorney, Agent, or Firm* — Pearne & Gordon LLP

(57) ABSTRACT

The hearing device comprises a battery door (20); a connector (2) having N≧1 electrical contacts (6); and a user control (8). The user control (8) consists of a) an elastic actuation member (14); and operationally connected thereto
b) a contact changing member (12), which can be different from or identical with the elastic actuation member (14); and operationally connected thereto
c) at least one of the N electrical contacts (6).

At least a portion of the elastic actuation member (14) forms at least a portion of the battery door (20). The connector (2) is a connector for providing a communication connection to the hearing device. The user control(8) can be a pushbutton switch. The elastic actuation member (14) comprises a body substantially made of elastomeric material and can hold the contact changing member (12). The contact changing member (12) is provided for changing the state of contacting of said at least one electrical contact (6), e.g., to establish or interrupt an electrical connection. Very small-size hearing devices can be realized.

21 Claims, 5 Drawing Sheets

HEARING DEVICE WITH USER CONTROL

TECHNICAL FIELD

The invention relates to the field of hearing devices. It relates to methods and apparatuses according to the opening clause of the claims.

Under a hearing device, a device is understood, which is worn in or adjacent to an individual's ear with the object to improve the individual's acoustical perception. Such improvement may also be barring acoustic signals from being perceived in the sense of hearing protection for the individual. If the hearing device is tailored so as to improve the perception of a hearing impaired individual towards hearing perception of a "standard" individual, then we speak of a hearing-aid device. With respect to the application area, a hearing device may be applied behind the ear, in the ear, completely in the ear canal or may be implanted.

Under audio signals we understand electrical signals, analogue and/or digital, which represent sound.

BACKGROUND OF THE INVENTION

Hearing devices are preferably very small, in particular in the case of In-The-Ear (ITE) hearing devices such as In-The-Channel (ITC) or Completely-In-the-Channel (CIC) hearing devices, but also in case of Behind-The-Ear (BTE) hearing devices. Nevertheless, it is desirable to provide a hearing device with a user interface comprising at least one user control, which allows a user of the hearing device to provoke changes the functioning of the hearing device such as selecting a hearing program.

It is possible to minimize the size of a hearing device and nevertheless provide a user interface by providing a remote control operationally connectable to the hearing device, which comprises said user interface. However, the user has to carry the remote control in order to be able to use the user interface, and a remote control adds considerable cost to the purchase price of the hearing system.

From U.S. Pat. No. 5,404,407, a hearing device is known, which comprises a socket with programming contacts to which a plug can be connected, so as to allow programming of the hearing device. Said socket is provided with a separate, additional contact, which is not used for programming the hearing device. Instead, this additional contact in the socket is used when the plug is not connected to the socket. For this purpose, a push button can be introduced into the socket. Said push button is composed of a switch housing having a PC motherboard with contact pins, a switch spring, an actuation element, and a contact bridge. This solution is cumbersome for several reasons, e.g., the disclosed pushbutton comprises many separate parts, which makes it large in size, cumbersome to assemble and susceptible to failures. And, in addition, the provision of an additional contact in a socket requires cumbersome modifications, not only to the socket, but also to each plug to be used with the socket of the hearing device, and the plugs are, at least as far as used for hearing device fitting, located at and owned by each hearing device professional. And furthermore, the disclosed pushbutton is an additional part to be attached to the hearing device, i.e. it has to be manufactured separately, it can be lost, and it requires a fair amount of space.

It is desirable to provide an alternative way of providing a small hearing device with a user interface.

SUMMARY OF THE INVENTION

One object of the invention is to create a hearing device that does not have the disadvantages mentioned above. A hearing device shall be provided, which comprises at least one user control, the addition of which results in no or only a small increase of volume of said hearing device. In addition, the respective method of operating a hearing device shall be provided, and furthermore, a use of at least one electrical contact of a connector of a hearing device shall be provided.

Another object of the invention is to minimize the size of a hearing device.

Another object of the invention is to provide a hearing device with a user control at no or little increase in size of said hearing device.

Another object of the invention is to provide a hearing device having an improved manufacturability.

Another object of the invention is to provide a hearing device of high reliability.

Another object of the invention is to provide a hearing device that can be handled well by a user of the hearing device.

Further objects emerge from the description and embodiments below.

At least one of these objects is at least partially achieved by apparatuses and methods according to the patent claims.

The hearing device comprises a battery door;

a connector having $N \geqq 1$ electrical contacts; and a user control;

wherein said user control consists of a) an elastic actuation member; and operationally connected thereto b) a contact changing member, which can be different from or identical with said elastic actuation member; and operationally connected thereto c) at least one of said N electrical contacts;

wherein at least a portion of said elastic actuation member forms at least a portion of said battery door.

Most hearing devices have a battery door for covering an energy supply member such as a battery within said hearing device during normal operation of the hearing device and for allowing access to said energy supply member, so as to allow to inserted a new energy supply member into the hearing device. If said elastic actuation member is, at least in part, comprised in said battery door, it is possible to save space, since battery door and user control share a portion of volume.

The fact, that the user control consists of the items a), b) and c), means that there are no additional items or parts of the user control. E.g., there is no additional lever of the user control and no additional housing part. Accordingly, the number of parts of the user control is very small. This improves the manufacturability of the hearing device and allows to create a particularly small user control.

In one embodiment, said elastic actuation member is integrally formed. This can improve the manufacturability and the reliability.

In one embodiment, said contact changing member is integrally formed. This can improve the manufacturability and the reliability.

In one embodiment, said connector is typically used for exchanging data between the hearing device and an external device such as a personal computer, e.g., during fitting of the hearing device. Such a connector is not used during normal operation of the hearing device.

In one embodiment, said at least one electrical contact is electrically contacted when a plug is connected to the connector and used for transmitting information such as digital data or signals to or from the hearing device.

In one embodiment, operating said user control comprises elastically deforming said elastic actuation member In one embodiment, the contact changing member is provided for changing the state of contacting of said at least one electrical contact. E.g., for at least one of establishing an electrical connection between said at least one electrical contact and another electrical contact;

interrupting an electrical connection between said at least one electrical contact and another electrical contact;

increasing the resistance between said at least one electrical contact and another electrical contact;

decreasing the resistance between said at least one electrical contact and another electrical contact.

Note that said establishing and said interrupting of an electrical connection can be considered a particular strong increasing and decreasing, respectively, of a resistance.

In one embodiment, said other electrical contact is an electrical contact of said hearing device, e.g., another electrical contact of said connector.

In one embodiment, said other electrical contact is an electrical contact of said hearing device, and an electrical voltage is applied to said other electrical contact. In particular, said other electrical contact is not an electrical contact of said connector. In particular, said electrical voltage is a pre-defined electrical voltage.

In one embodiment, said elastic actuation member substantially is a body substantially made of elastomeric material.

In one embodiment, said elastic actuation member comprises a body substantially made of elastomeric material.

Said elastic actuation member may be elastically deformed, e.g., be compressed (or expanded) by the user when said user control is operated. When the user stops operating the user control, energy stored in the elastic deformation of the elastic actuation member can be used for reinstalling the original state of the elastic actuation member, i.e., the deformation of the elastic actuation member is undone.

In one embodiment, said hearing device comprises said elastic actuation member for resetting said user control (and in particular said contact changing member) into its original state (in particular, position and/or shape) after said user control has been operated by deforming said elastic actuation member. This allows to realize a user control that can be easily operated many times.

In one embodiment, said elastomer is a rubber-like material such as natural or synthetic rubber, silicone, a rubber-like polymer.

In one embodiment, said elastic actuation member, said contact changing member and said at least one electrical contact are designed and arranged such that elastically deforming said elastic actuation member for operating said user control causes a change in shape and/or location of said contact changing member, which causes a change in the state of contacting of said at least one electrical contact.

In one embodiment, said hearing device comprises a housing; and, in the area right above said connector, said housing is formed by said elastic actuation member. This allows to provide a particularly small user control.

In one embodiment, said at least one electrical contact is configured to be used for transmitting information in electrical form to or from said hearing device when said battery door is open and a plug is connected to said connector; and said at least one electrical contact is configured to be used in the operation of said user control when said battery door is closed. Said information transmitted in electrical form can be, e.g., audio signals (in digital and/or analog form), or data such as hearing device fitting data.

In one embodiment, said connector is a socket, and said at least one connector is a contact pin. Sockets with contact pins are provided in many hearing devices. Sockets like the well-known CS44-type socket or other miniature sockets may be used.

In one embodiment, said connector comprises a printed circuit board, and, in particular, said at least one connector is a contact pad of said printed circuit board. This embodiment allows the construction of a particularly space-saving user control.

In one embodiment, said battery door and said elastic actuation member are jointly manufactured in a multi-injection molding process. This is a particularly advanced way of manufacturing, which reduces the number of manufacturing steps that need to be carried out manually. Multi-injection molding allows, in addition, to reduce the size of parts to be manufactured. And furthermore, it is readily possible to produce a firm connection between portions of different materials (of an injection-molded body) when using a multi-injection molding process for the manufacture.

In one embodiment, said battery door has an opening, and said elastic actuation member has a waist and is attached to said battery door, said waist located within said opening.

In one embodiment, said elastic actuation member closes or even seals said opening. For hearing devices worn in or near the ear, sweat and cerumen are a problem, in particular with respect to corrosion of metal parts of the hearing device. Therefore, it can be advantageous to seal said connector. Said elastic actuation member or a part thereof can be used to accomplish this task. An elastomer is particularly well suited for this.

In one embodiment, said elastic actuation member is at least in part formed by said battery door, said contact changing member being a part separate from said at least one part of said elastic actuation member formed by said battery door, and said contact changing member is located within said connector. In this case, when opening the battery door, the elastic actuation member will—at least in part—be moved away from the other parts of the user control, in particular from the contact changing member. Accordingly, before inserting a plug into said connector, it will usually be necessary to remove the contact changing member from said connector.

In one embodiment, said elastic actuation member is formed by said battery door, said contact changing member being a part separate from said elastic actuation member, and said contact changing member is located within said connector. In this case, when opening the battery door, the elastic actuation member will be moved away from the other parts of the user control, in particular from the contact changing member. Accordingly, before inserting a plug into said connector, it will usually be necessary to remove the contact changing member from said connector.

In one embodiment, said contact changing member is, at least in part, electrically conductive.

In one embodiment, said contact changing member is a metallic member.

In one embodiment, said contact changing member is a metallic member comprising a fixing end, said contact changing member being fixedly held in said elastic actuation member at said fixing end. In this case, when opening the battery door, the elastic actuation member together with the contact changing member will be moved away from the electrical contacts of the user control.

In one embodiment, said contact changing member is designed to stay substantially undeformed during operation of said user control. In this case, the elastic actuation member is typically designed such that it compensates for manufacturing tolerances.

In one embodiment, said contact changing member is a piece of metal generally extending along an axis, said axis being substantially identical with an axis along which said contact changing member is moved when said user control is operated. Furthermore, said contact changing member has an acting end and, at its opposite end, a fixing end, said acting end being arranged—along said axis—below said fixing end and closer to said at least one electrical contact. Typically, said acting end generally points towards said at least one electrical contact, whereas said fixing end generally points away from said at least one electrical contact, and the directions of said pointing generally being aligned along said axis. This allows the construction of a relatively sturdy user control.

In one embodiment, the hearing device comprises a housing, and neither said housing nor said battery door comprises a lever, wherein said lever would be not identical with said battery door and designed to rotate about an axis upon operation of the user control. In other words, in this embodiment, there is no lever comprised in said hearing device, which lever would have the property that it would rotate about an axis when the user control is operated. And, said lever furthermore has the property that it is not identical with said battery door. Of course, it is possible, that in a hearing device according to the invention, the battery door is rotatable about an axis and has some rotational play in its closed state, typically due to manufacturing tolerances. Such a battery door is not a lever as depicted above.

The method is a method of operating a hearing device comprising a battery door, a connector with N≧1 electrical contacts, and a user control. Said method comprises the step of using at least one of said N electrical contacts of said connector as a part of said user control.

In addition, said user control consists of a) an elastic actuation member; and operationally connected thereto b) a contact changing member, which can be different from or identical with said elastic actuation member; and operationally connected thereto c) said at least one electrical contact;

wherein at least a portion of said elastic actuation member forms at least a portion of said battery door.

Accordingly, said connector and said user control can share components, namely at least said at least one electrical contact. Thus, a small-size hearing device can be realized. Most modern hearing devices comprise a connector, typically for exchanging data with an external device such as a personal computer, e.g., during fitting of the hearing device. Such a connector is not used during normal operation of the hearing device, but typically only when a hearing device professional such as a hearing device fitter or an audiologist adjusts or tests the hearing device. Accordingly, it is possible to make use of said connector or parts thereof for other purposes during normal operation of the hearing device. Electrical contacts of the connector are already connected to the hearing device's circuitry, so that monitoring the electrical status of said electrical contacts in an appropriate fashion is readily implementable.

One other purpose for which said electrical contacts can be used is for being involved in receiving user input. A user of the hearing device may want to change the functioning of the hearing device during normal operation of the hearing device. E.g., the user may want to change an audio processing parameter of the hearing device such as the output volume or select a different hearing program, or select one of several input units such as internal or external microphones. For accomplishing this, the user operates a user control such as a dial, wheel or switch, in particular a pushbutton.

The invention allows to miniaturize the hearing device by a combined use of components of said connector and said user control. Electrical contacts of said connector can be used as electrical contacts of the user control.

In one embodiment of the method, said elastic actuation member is integrally formed, and said contact changing member is integrally formed.

In one embodiment, the method comprises the step of operating said user control by elastically deforming said elastic actuation member, thereby causing a change in shape and/or location of said contact changing member, thereby causing a change in the state of contacting of said at least one electrical contact.

In one embodiment, said method comprises the step of changing the state of contacting of said at least one electrical contact by means of said contact changing member by at last one of establishing an electrical connection between said at least one electrical contact and another electrical contact;

interrupting an electrical connection between said at least one electrical contact and another electrical contact;

increasing the resistance between said at least one electrical contact and another electrical contact;

decreasing the resistance between said at least one electrical contact and another electrical contact.

In one embodiment, said method comprises the steps of when said battery door is open and a plug is connected to said connector: transmitting information in electrical form to or from said hearing device via at least said at least one electrical contact and said plug;

when said battery door is closed: using said at least one electrical contact in the operation of said user control.

Accordingly, one and the same electrical contact serves (at least) two purposes: on the one hand, participating in communication typically with an external device via a plug connected to the connector, and on the other hand, using it when operating the user control.

In one embodiment, said user control is a pushbutton, and operating said user control comprises pushing said pushbutton.

In one embodiment, said user control is integrated in said hearing device during normal operation of the hearing device. This means that during normal hearing device operation, said user control is attached to or is part of the hearing device, i.e. that the user control is not an item which is occasionally or temporally attached to the hearing device.

In one embodiment, said method comprises the steps of changing a state of contacting of said at least one electrical contact by operating said user control; and detecting said change of state of contacting of said at least one electrical contact.

In one embodiment, said contact changing member comprises a shorting member, and said method comprises the steps of establishing an electrical connection between at least two of said N electrical contacts of said connector by operating said user control, which operating causes said shorting member to electrically connect said at least two electrical contacts with each other; and detecting said establishment of said electrical connection.

This allows for a simple and safely functioning implementation of the user control. E.g., the electrical resistance between said at least two electrical contacts can be monitored, and a strong change (increase and/or decrease) of said resistance as it will occur, e.g., when shorting said at least two electrical contacts by operating the user control, can be used as a signal indicating that a switching has taken place and that a corresponding action such as changing the hearing program or the output volume shall take place.

It is also possible to measure the time duration during which a change state of contacting occurred, i.e. to determine for how long the user control has been operated. Depending on the measured time, one of several possible commands will be carried out. E.g., operating the user control for a short duration leads to an increase in volume, whereas operating the user control for a longer duration leads to the selection of a different hearing program.

It is also possible to measure a voltage and carry out a command selected in dependence of the measured voltage. E.g., operating the user control could result in electrically contacting said at least one electrical contact with another electrical contact, which is on a certain electrical potential, and the measured voltage is a voltage with respect to said at least one electrical contact. For embodiments with a dial-type (rotatable) user control, this can be an elegant solution for allowing the hearing device user to easily select from a multitude of possible commands.

Instead of shorting said at least two electrical contacts when operating the user control, it is, e.g., also possible to interrupt an electrical connection between said at least two electrical contacts when operating the user control.

The use is a use of at least one of $N \geqq 1$ electrical contacts of a connector of a hearing device as at least one electrical contact of a user control of said hearing device, wherein said hearing device comprises a battery door, and wherein said user control consists of a) an elastic actuation member; and operationally connected thereto
b) a contact changing member, which can be different from or identical with said elastic actuation member; and operationally connected thereto
c) said at least one electrical contact;

wherein at least a portion of said elastic actuation member forms at least a portion of said battery door.

The invention comprises methods with features of corresponding hearing devices according to the invention, and vice versa, and uses with features of corresponding hearing devices or methods according to the invention.

The advantages of the methods correspond to the advantages of corresponding apparatuses and vice versa, and the advantages of the uses correspond to the advantages of corresponding apparatuses or methods.

Further embodiments and advantages emerge from the dependent claims and the figures.

BRIEF DESCRIPTION OF THE DRAWINGS

Below, the invention is described in more detail by means of examples and the included drawings. The figures show.

The reference symbols used in the figures and their meaning are summarized in the list of reference symbols. The described embodiments are meant as examples and shall not confine the invention.

DETAILED DESCRIPTION OF THE INVENTION

Figure 1:
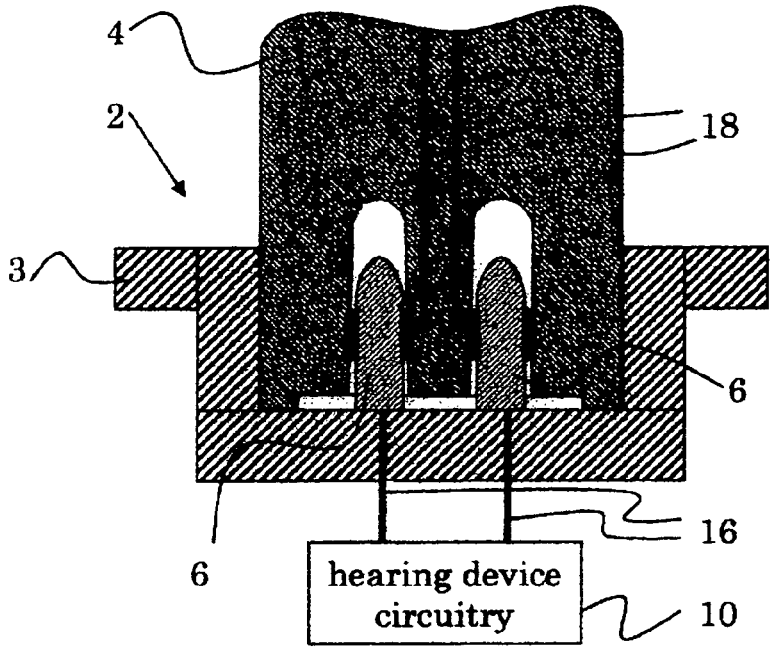
FIG. 1 a cross-section through a connector with plug attached, schematically.

FIG. 1 schematically shows a cross-section of a detail of a hearing device, more precisely, a cross-section through a connector 2, with a plug 4 attached, as it is known in the art. The connector 2, e.g., a CS44-type socket, is attached to or incorporated in a housing 3 of the hearing device and has electrical contacts 6, e.g., contact pins 6. These are connected via electrical connections 16 to the hearing device circuitry 10, i.e. to the electronics of the hearing device. When data shall be read from the hearing device or when data shall be loaded into the hearing device, plug 4 is connected to connector 2, so that the contact pins 6 are electrically contacted, so as to connect the connector 2 via electrical connections 18 to a device external to the hearing device, e.g., to a computer. Such a connection to an external device is used, e.g., during fitting of the hearing device or for updating the hearing device software or for exchanging audio signals or for some other communication purposes.

As shown in FIG. 1, the electrical connection between plug 4 and connector 2 is typically made at the shaft of the contact pins 6.

Figure 2:
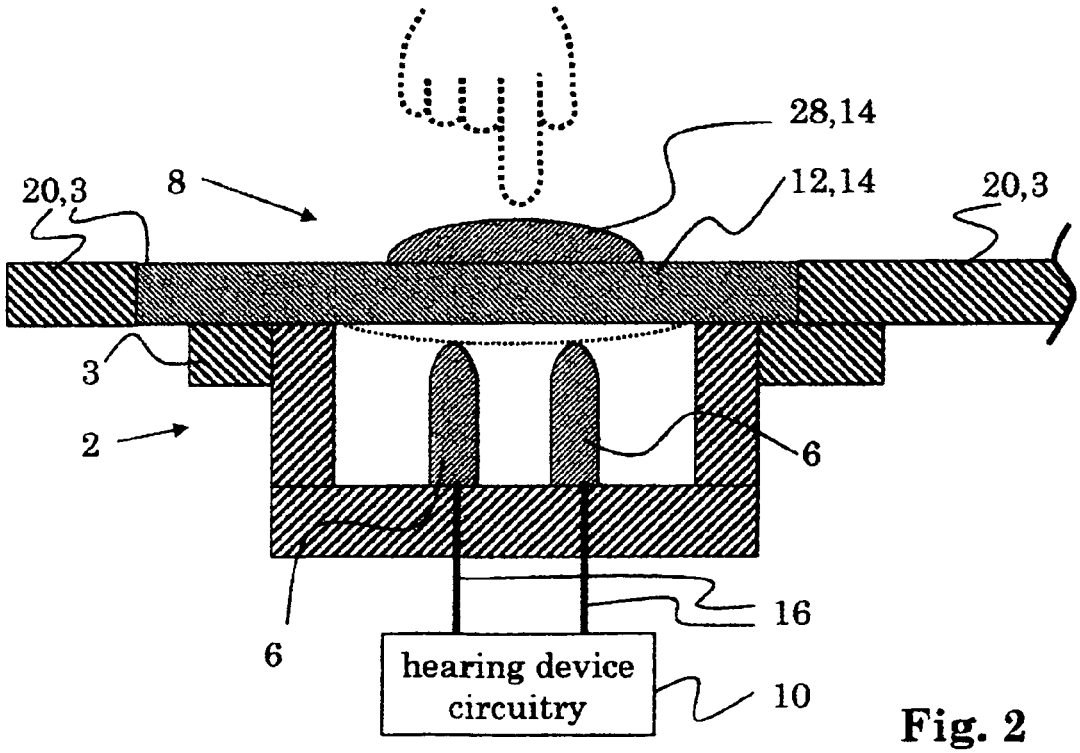
FIG. 2 a cross-section through a connector and user control, schematically.

FIG. 2 schematically shows a cross-section of a detail of a hearing device according to the invention, more precisely, a cross-section through a connector 2 and a user control 8. The connector 2 can be the same as the one in FIG. 1. During normal operation of the hearing device, there is no plug applied to connector 2. Accordingly, it is possible to use the contacts 6 differently then. It is possible to use contacts 6 as part of said user control 8. User control 8 furthermore comprises a contact changing member 12, which, at the same time, can be comprised in an elastic actuation member 14. Optionally, user control 8 comprises, as shown in FIG. 2, a tactile member 28, which also can, at the same time, be comprised in elastic actuation member 14.

Contact changing member 12 shall, when user control 8 is operated, change a state of contacting of at least one of the electrical contacts 6, e.g., establish or interrupt an electrical connection, e.g., an electrical connection between two electrical contacts 6. This change in state of contacting can be detected, e.g., via a change in an electrical current. In the embodiment illustrated in FIG. 2, an electrical connection, in particular a short, between the two electrical contacts 6 is established when user control 8 is operated. Accordingly, a contact changing member 12 like the one depicted in FIG. 2 can be considered a shorting member.

Elastic actuation member 14 shall reset user control 8 into its original state, in particular its original position and shape, after it has been operated. Elastic actuation member 14 can be substantially a body made of elastomeric material. The elastic actuation member 14 forms a portion of a battery door 20 of the hearing device, wherein the battery door 20 forms a portion of a housing 3 of the hearing device.

Tactile member 28 shall allow a user to find a suitable spot for operating user control 8 without looking, typically solely be touching and sensing with a finger. Tactile member 28 can therefore comprise a protrusion and/or is made of or covered with a material that is different from neighboring portions of the outside of the hearing device.

As indicated by the dashed hand symbol, a user of the hearing device can press user control 8, with the effect that contact changing member 12 is moved towards the contacts 6 (cf. the dashed line) and establishes an electrical connection between said contacts 6. Accordingly, user control 8 forms a switch, more precisely a pushbutton. It is to be noted that in typical embodiments, the size of a user's fingertip would, if drawn to scale in FIG. 2, be much larger than the hand symbol and also much larger than the user control 8. The same applies to FIGS. 13 and 14.

The user applies a force to user control 8 by pressing onto elastic actuation member 14, which can be substantially made of an elastomer such as silicone. Where the elastic actuation member 14 forms the contact changing member 12, it can be substantially made of a conductive polymer; alternatively, the elastic actuation member 14 could be covered with an electrically conductive layer.

Preferably, the deformation, which is applied to the elastic actuation member 14 is an elastic deformation, so that the energy provided by the user by pressing the user control 8 is, with no or little loss, stored in the elastic actuation member 14 and can cause the elastic actuation member 14 to regain its original shape after the user stopped pressing. Thus, a pushbutton can be realized which can be easily operated many times.

Since the contact pins 6 are anyway connected to the electronic circuitry 10 of the hearing device, it is, with only little effort, possible to detect that user control 8 has been operated, e.g., by detecting that the electrical resistance between the two contact pins 6 drops, or that it is low or that is rises (when the user stopped pressing).

Accordingly, user control 8 can be used as a means for the user to provide input to the hearing device during normal operation of the hearing device. E.g., upon operating user control 8, another hearing program could be selected, or the output volume could be increased (or decreased). It will usually also be helpful to generate an acknowledge signal such as a beep when user control 8 is operated, so that the user is informed when he successfully operated user control 8.

Figure 10:
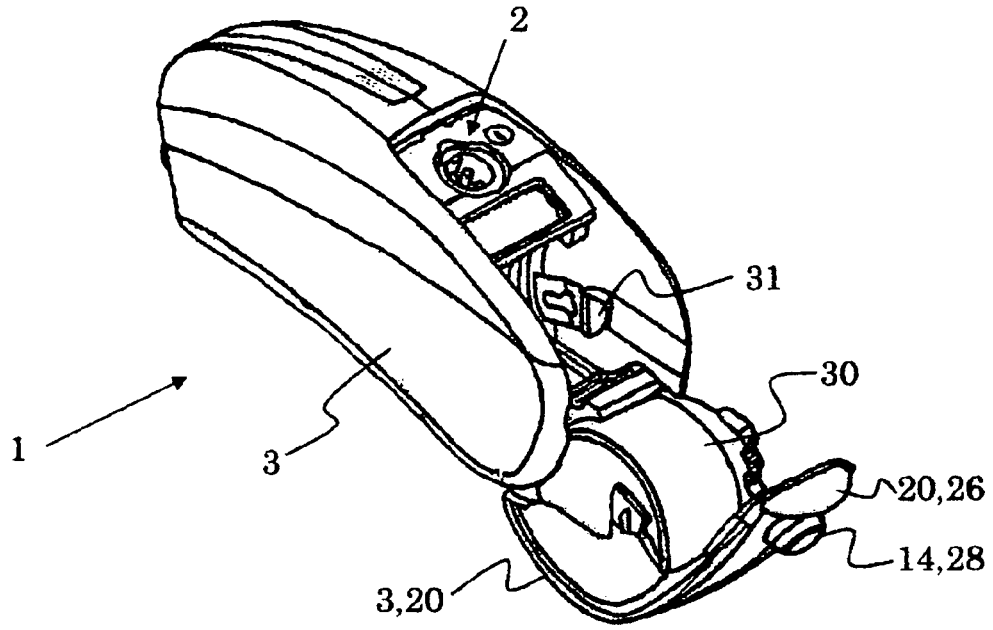
FIG. 10 a hearing device with open battery door, in perspective view.

FIG. 10 shows a hearing device 1 in a perspective view. The hearing device of FIG. 10 is a BTE hearing device, e.g., a BTE hearing-aid device.

The hearing device 1 has a housing 3, which comprises a battery door 20, which can be opened by a user by pulling an opening member 26. Battery door 20 is pivotable (rotatable) about a pivot joint and forms a portion of housing 3. In FIG. 10, battery door 20 is open. In hearing device 1, a user control is integrated, parts of which are integrated in battery door 20, namely an elastic actuation member 14, which also forms a tactile member 28.

With the battery door 20 open, a user can replace a battery 30, which is electrically contacted by a battery contact 31 when battery door 20 is closed. A connector 2 of the hearing device, e.g., a CS44 socket, is uncovered when the battery door 20 is open. In this state, a plug could be connected to connector 2. One or more contacts of connector 2 belong—in the normal state of the hearing device with battery door 20 closed—to said user control, as does a contact changing member (not visible in FIG. 10) integrated in said battery door 20.

Figure 3:
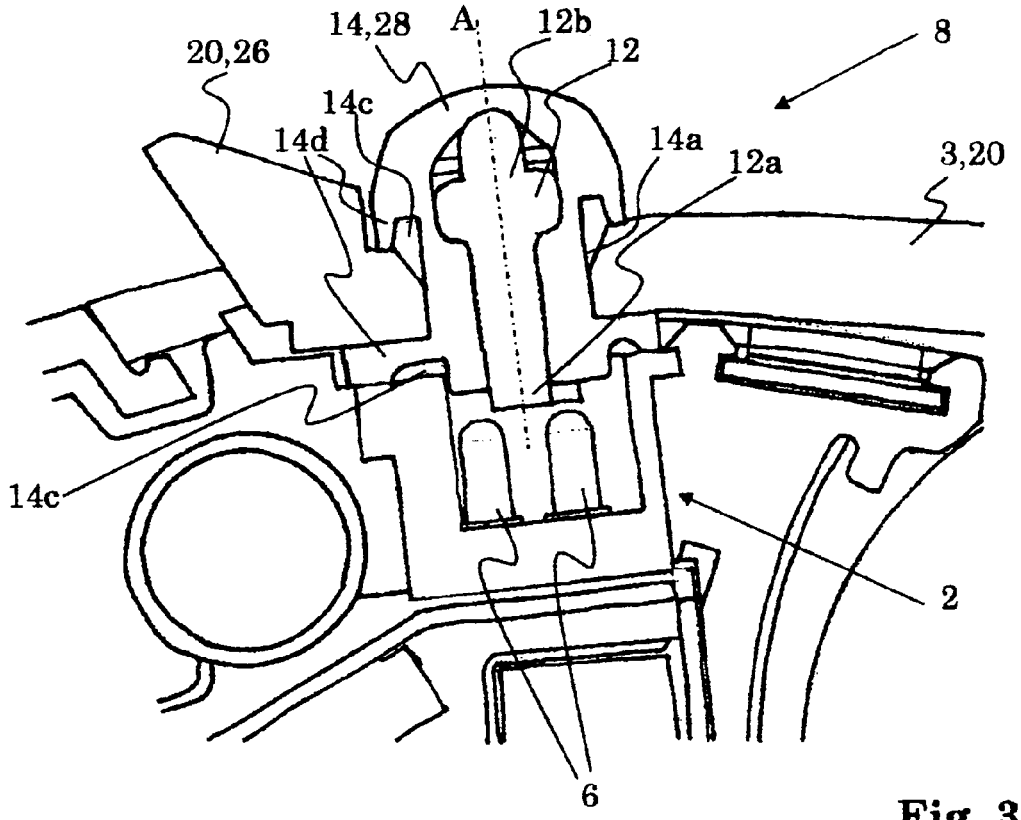
FIG. 3 a cross-section through a detail of a hearing device with connector and user control.

FIG. 3 shows a cross-section through a detail of a hearing device with connector 2 and user control 8, e.g., of a hearing device 1 like the one shown in FIG. 10. The elastic actuation member 14 is a body of an elastomer such as silicone, which is held in an opening of battery door 20. Inside elastic actuation member 14, a contact changing member 12 is located.

For improved fixation in battery door 20, elastic actuation member 14 has a waist 14*a*, such that the lateral extension of elastic actuation member 14 at waist 14*a*, which is located on the level of battery door 20, is smaller than its lateral extension on the inner side of battery door 20 and its lateral extension on the outer side of battery door 20. Below and/or above battery door 20, elastic actuation member 14 forms hollows 14*c*. Shape and volume of hollows 14*c* and shape and volume of the elastomeric material at 14*d* are chosen such that user control 8 can be operated properly, i.e. that it can be operated by the application of a suitable force and that the application of a large force does not result in a too large movement of contact changing member 12, which could result in damage, e.g., plastic deformation of electrical contacts 6. Elastic actuation member 14 is generally rotationally symmetric with respect to an axis A, but may be faceted or provide other asymmetries, in particular at waist 14*a*, in order to prevent a rotational change in position (with respect to battery door 20 and, accordingly, with respect to plug 2 and contacts 6). Tactile member 28 is arranged above electrical contacts 6. A portion of elastic actuation member 14, mainly at waist 14*a* and at 14*d*, seals the connector 2, thus preventing connector 2 (and the contact changing member 12) from being corroded by cerumen or sweat or hair care products.

Elastic actuation member 14 comprises a central hollow in which contact changing member 12 is held. Elastic actuation member 14 is furthermore shaped in such a way that it can be inserted into battery door 20 after insertion of contact changing member 12 into the central hollow of elastic actuation member 14.

Figure 4:
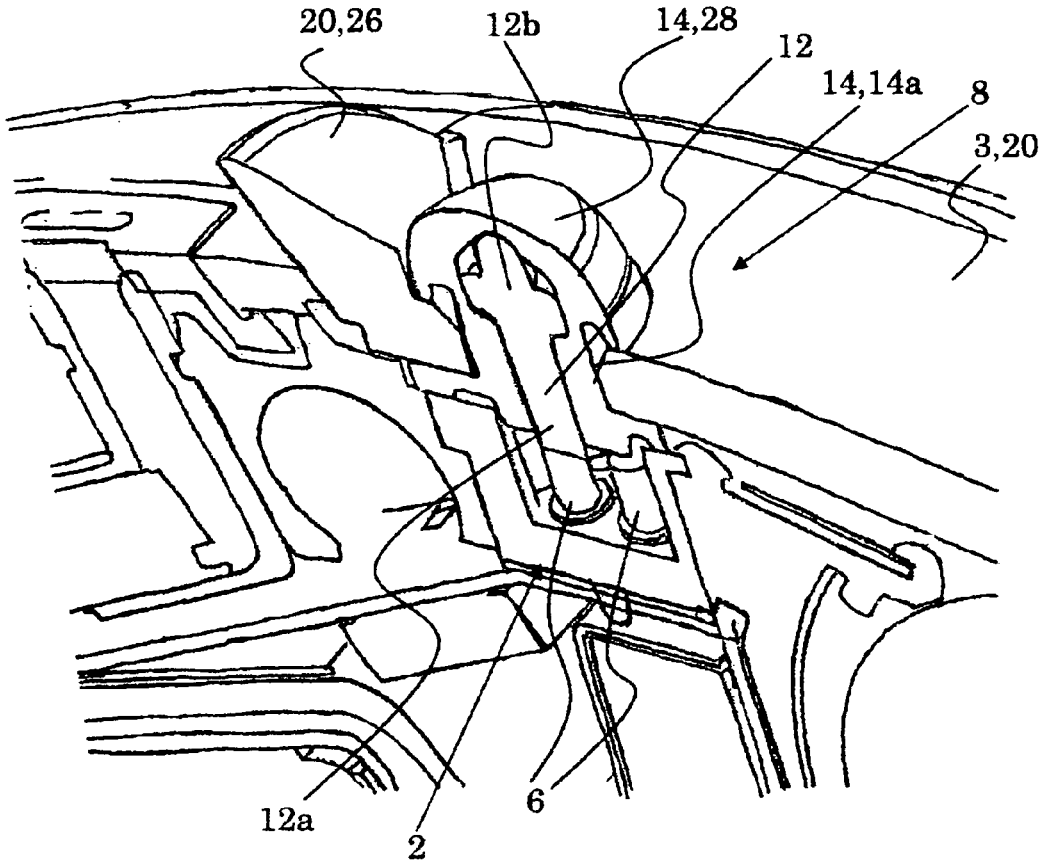
FIG. 4 a perspective view onto a cross-section through a detail of a hearing device with connector and user control.

FIG. 4 shows a perspective view onto generally the same cross-section as FIG. 3.

Figure 5:
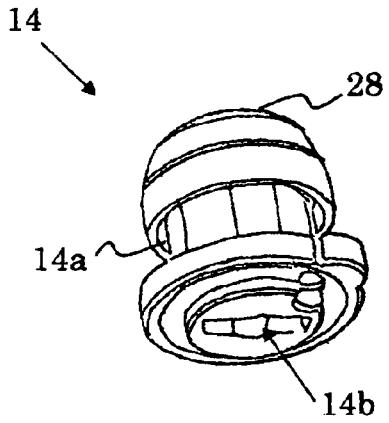
FIG. 5 an elastic actuation member like the one shown in FIGS. 3 and 4, in perspective view.

FIG. 5 shows in a perspective view an elastic actuation member 14 like the one shown in FIGS. 3 and 4. An opening 14*b* of elastic actuation member 14 is visible, which contributes to the central hollow of elastic actuation member 14, and which allows to introduce a portion of contact changing member 12 into elastic actuation member 14.

Figure 6:
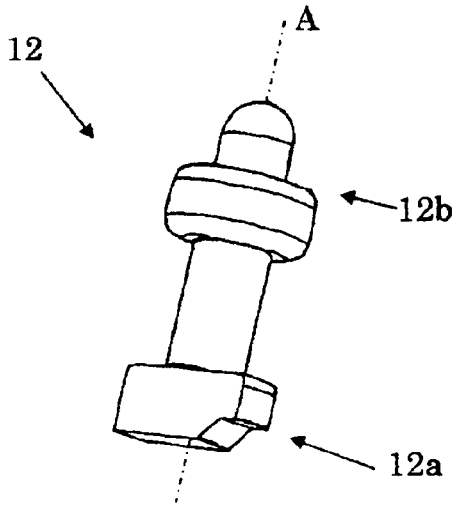
FIG. 6 a contact changing member like the one shown in FIGS. 3 and 4, in perspective view.

FIG. 6 shows in a perspective view a contact changing member 12 like the one shown in FIGS. 3 and 4. It is preferably made of metal. It is generally extended along axis A (cf. also FIG. 3) and comprises an acting end 12*a* and a fixing end 12*b*. Acting end 12*a* provides an electrical connection between two electrical contacts 6 of connector 2 (cf. FIGS. 3 and 4) when the user control 8 is operated by applying a force generally along axis A, pointing towards the inside of the hearing device. Its shape ensures, together with the opening 14*b* of elastic actuation member 14 (cf. FIG. 5), that no mutual rotation of changing member 12 and elastic actuation member 14 takes place and that always only the desired (preselected) one or more electrical contacts 6 are properly shorted, when user control 8 is operated.

Fixing end 12*b* ensures, together with the shape of the central hollow of elastic actuation member 14, that contact changing member 12 cannot move out of elastic actuation member 14 when it is inserted in battery door 20.

Figure 11:
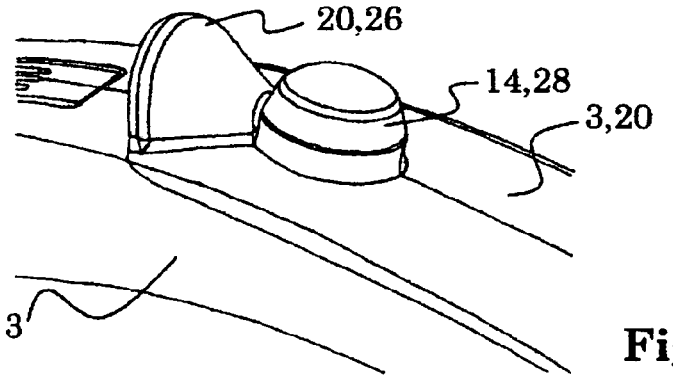
FIG. 11 a detail of the hearing device of FIG. 10, in perspective view.

FIG. 11 shows a detail of the hearing device of FIGS. 3, 4 and 10 in a perspective view. Opening member 26 is arranged and shaped such that it prevents an unintentional pulling-out of elastic actuation member 14 out of battery door 20 when trying to open the battery door 20 and slipping off opening member 26.

Figure 12:
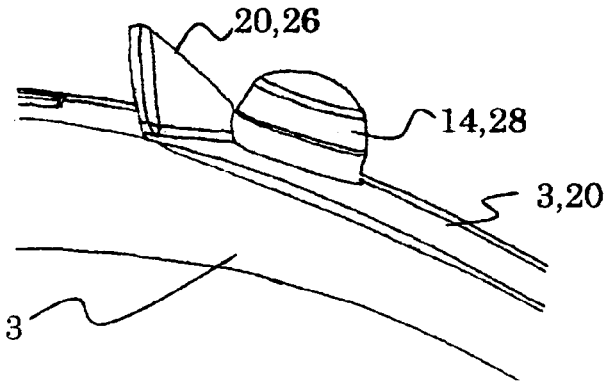
FIG. 12 a detail of the hearing device of FIG. 10, in perspective view.

FIG. 12 shows a different perspective view of the same situation as shown in FIG. 11.

Figure 7:
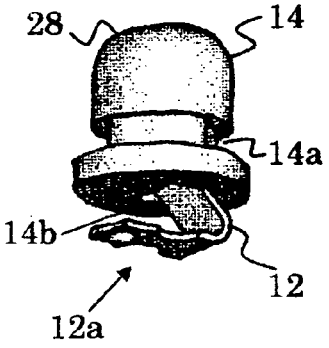
FIG. 7 an elastic actuation member with a contact changing member, in perspective view.
Figure 8:
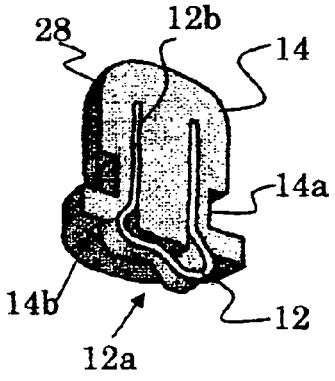
FIG. 8 an elastic actuation member with a contact changing member, in a perspective view onto a cross-section.
Figure 9:
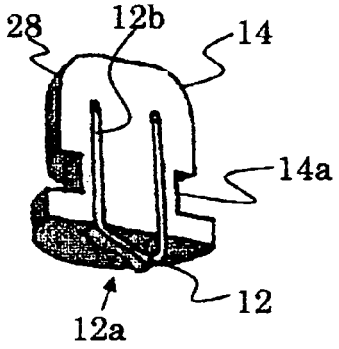
FIG. 9 an elastic actuation member with a contact changing member, in a perspective view onto a cross-section.

FIGS. 7, 8 and 9 each show an elastic actuation member 14 with a contact changing member 12 in a perspective view, in case of FIGS. 8 and 9, a cross-section is shown. Instead of a generally rod-shaped contact changing member 12 shown in FIG. 6, FIGS. 7 to 9 show contact changing members 12 formed from a piece of sheet metal.

In FIG. 7, a flat portion in waist 14*a* is visible, which allows to prevent that elastic actuating member 14 can move rotationally when inserted in a correspondingly formed opening in a battery door.

Figure 13:
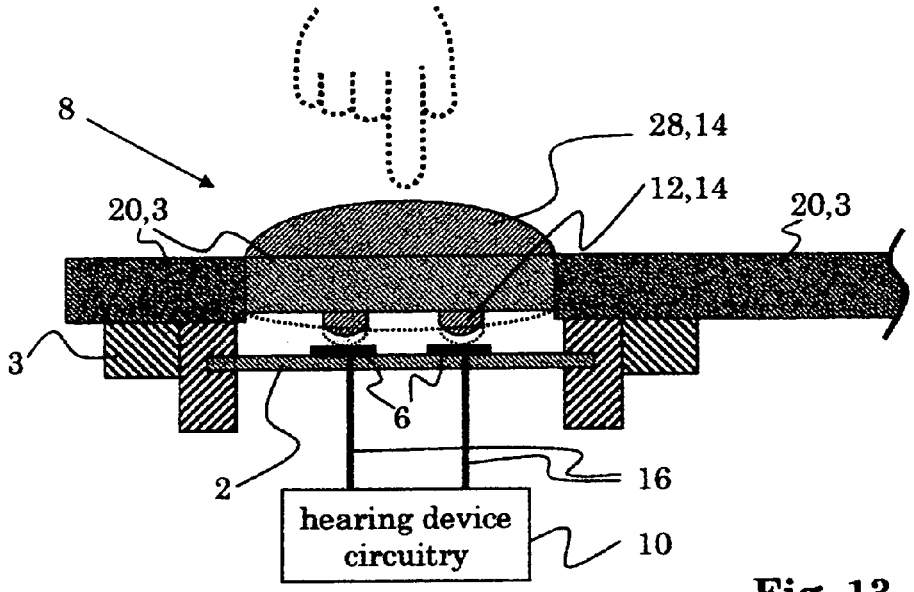
FIG. 13 a cross-section through a connector and user control, schematically.

FIG. 13 schematically shows a cross-section through a connector 2 and user control 8. In this case, connector 2 is printed circuit board, and contacts 6 are contact pads on the printed circuit board. With a "plug", i.e. a counterpart to the connector, attached to the connector, it is possible, e.g., to exchange audio signals between the hearing device and an external device.

It is possible, as shown in FIG. 13, to incorporate the contact changing member 12 in the elastic actuation member 14, and to provide a contact changing member 12 with protrusions. The dashed lines indicate the approximate position/shape of elastic actuation member 14 and contact changing member 12 (near electrical contacts 6) during operating (pressing) user control 8. Contact changing member 12 can be realized by using a conductive elastomer for at least the lower part of elastic actuation member 14. It is also possible to realize contact changing member 12 by conductively coating the inward-pointing side of elastic actuation member 14, or by attaching a solid metallic body to elastic actuation member 14.

Embodiments with a printed circuit board as connector 2 (or as a portion of a connector 2) and contact pads of the printed circuit board as electrical contacts 6 can be considerably smaller (less space-consuming) than when a connector with contact pins such as a conventional socket is used. This applies also to other embodiments with a connector 2 comprising a printed circuit board, in which a different small-size solution for embodying electrical contacts 6 is realized. E.g., the printed circuit board can comprise one or more clamps for holding a counterpiece ("plug", e.g., another printed circuit board, in particular, a flexible printed circuit board). Therein, the one or more clamps can at the same time be the at least one electrical contact 6.

It is, of course, possible to realize a connector 2, which is or comprises a socket, and which comprises at least one printed circuit board. Therein, the at least one electrical contact 6 can be at least one contact pad of said at least one printed circuit board. Said socket can, e.g., comprise a bayonet mount for holding a plug.

It is to be noted that it is also possible to provide, as a connector or as a portion thereof, a printed circuit board (or two printed circuit boards) which is (are) arranged substantially perpendicularly to the housing of the hearing device instead of substantially parallel thereto, as shown in FIG. 13. For example, the contact pads could be located in a slit one or both sides of which being formed by printed circuit board. A suitable counterpiece (plug) for such a connector could be, e.g., another printed circuit board, in particular a flexible printed circuit board.

Please note that embodiments with at least one printed circuit board as connector 2 or as a portion thereof and at least one contact pad of the at least one printed circuit board as at least one electrical contact 6 can be realized also in case that no portion of the elastic actuation member 14 is forming a portion of a battery door.

Figure 14:
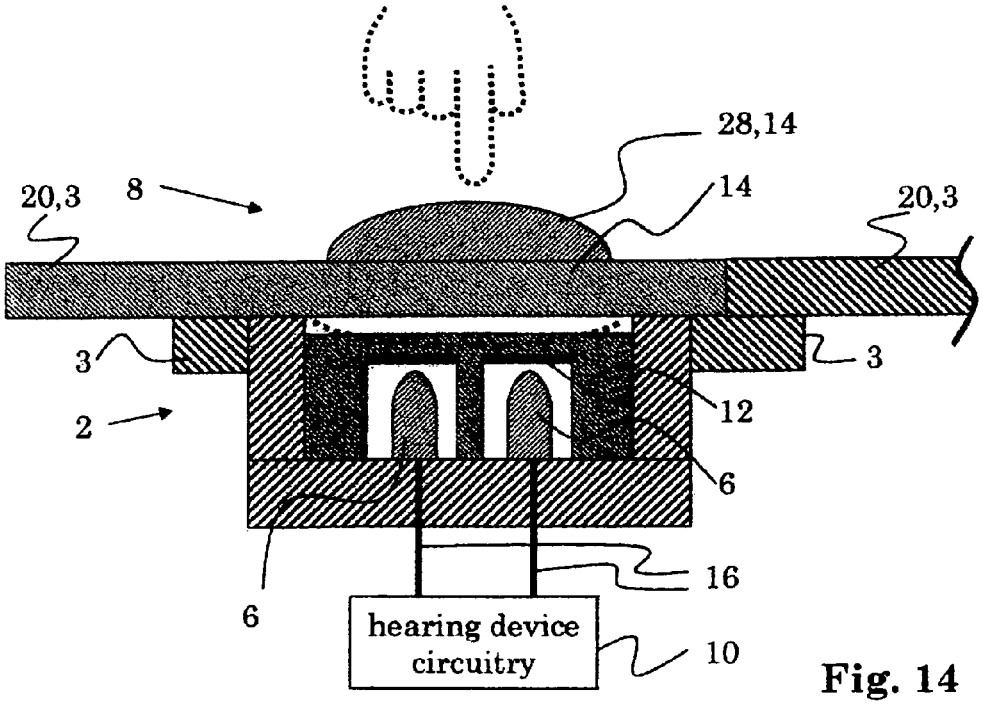
FIG. 14 a cross-section through a connector and user control, schematically.

It is furthermore possible—in various embodiments, not only in the embodiments of FIG. 2, 13 or 14—to form battery door 20 and elastic actuation member 14 in one process, instead of manufacturing them separately and assembling them afterwards. In particular, a multi-injection molding process could be used to jointly form both, battery door 20 and elastic actuation member 14. The bonding between battery door 20 and elastic actuation member 14 achievable this way is very good. It is also possible—additionally or alternatively—to incorporate the contact changing member 12 in elastic actuation member 14 in an injection molding process. This can be particularly advantageous when the contact changing member 12 is a pre-fabricated part, e.g., a metal body, such as shown, e.g., in FIGS. 3 to 6. A manual fixation of contact changing member 12 in elastic actuation member 14 can be rendered superfluous.

FIG. 14 schematically shows a cross-section through a connector 2 and user control 8. In this embodiment, the contact changing member 12 is separate from the elastic actuation member 14 held in the battery door 20. In particular, it is located at or in connector 2. Opening battery door 20 will in this case separate the elastic actuation member 14 held in the battery door 20 from contact changing member 12; and in order to be able to apply a plug to connector 2, contact changing member 12 will have to be removed therefrom first.

The embodiment of FIG. 14 can be considered to comprise a two-part elastic actuation member 14. One part is held in the battery door 20, the other part is located in connector 2.

Instead of creating a shorting path between two electrical contacts of connector 2 by operating a user control 8, it would also be possible to interrupt an existing electrical connection by operating the user control 8. It would also be possible to use more than two contacts of connector 2, or to use only one contact of connector 2. In the latter case, typically one additional contact elsewhere would be involved. It would also be possible to create a less drastic change in resistance upon operating the user control. The following can happen, when the state of contacting of said at least one electrical contact is changed: A flow of electrical current through said at least one electrical contact is changed, wherein changing comprises increasing and decreasing and creating and suppressing. Note that there will always be a—possibly very tiny—electrical current involved when detecting a current, a voltage or a resistance.

It is space-saving when an elastic actuation member is—at least in part—incorporated in a battery door, because this way, only one openable member has to be provided which at the same time provides access to the battery and to the connector when opened; and only one opening member 26 has to be provided.

In the description above, standard components of a hearing device such as input converter, signal processing unit and output converter have not been described. These are sufficiently well known to a person skilled in the art and from the state of the art.

The invention allows to integrate functionality into a hearing device with no or only little increase of the size of the hearing device, and it allows to provide the hearing device with functionality that does not have to be placed in a remote control for the hearing device.

LIST OF REFERENCE SYMBOLS

1 hearing device
2 connector, socket, printed circuit board
3 housing
4 plug
6 electrical contact, contact pin, contact pad
8 user control, switch, pushbutton
10 circuitry, hearing device circuitry, hearing device electronics
12 contact changing member, shorting member
12*a* acting end
12*b* fixing end
14 elastic actuation member, elastomer body
14*a* waist
14*b* opening, opening for contact changing member
14*c* hollow
16 connection
18 connection
20 battery door
26 opening member
28 tactile member
30 energy supply member, battery
31 battery contact
A axis

The invention claimed is:

1. A hearing device (1) comprising
a battery door (20);
a connector (2) having N≧1 electrical contacts (6); and
a user control (8);
wherein said user control (8) comprising:
a) an elastic actuation member (14); and operationally connected thereto
b) a contact changing member (12), which can be different from or identical with said elastic actuation member (14); and operationally connected thereto
c) at least one of said N electrical contacts (6);
wherein at least a portion of said elastic actuation member (14) forms at least a portion of said battery door (20), wherein at least one of said N electrical contacts (6) is configured to be used for transmitting information in electrical form to or from said hearing device (1) when said battery door (20) is open and a plug (4) is connected to said connector (2), and wherein said at least one of said electrical contacts (6) is configured to be used in the operation of said user control (8) when said battery door (20) is closed.

2. The device (1) according to claim 1, wherein said elastic actuation member (14) comprises a body substantially made of elastomeric material.

3. The device (1) according to claim 1 or claim 2, wherein said elastic actuation member (14), said contact changing member (12) and said at least one electrical contact (6) are designed and arranged such that elastically deforming said elastic actuation member (14) for operating said user control (8) causes a change in shape and/or location of said contact changing member (12), which causes a change in the state of contacting of said at least one electrical contact (6).

4. The device (1) according to claim 1, wherein said hearing device (1) comprises a housing (3), and wherein, in the area right above said connector (2), said housing (3) is formed by said elastic actuation member (14).

5. The device (1) according to claim 1, wherein said connector (2) is a socket, and at least one of said N electrical contacts (6) is a contact pin.

6. The device (1) according to claim 1, wherein said connector (2) comprises a printed circuit board, and at least one of said N electrical contacts (6) is a contact pad of said printed circuit board.

7. The device (1) according to claim 1, wherein said battery door (20) and said elastic actuation member (14) are jointly manufactured in a multi-injection molding process.

8. The device (1) according to claim 1, wherein said elastic actuation member (14) is formed by said battery door (20), said contact changing member (12) being a part separate from said elastic actuation member (14), said contact changing member (12) being located within said connector (2).

9. The device (1) according to claim 1, wherein said contact changing member (12) is a metallic member comprising a fixing end (12*b*), said contact changing member (12) being fixedly held in said elastic actuation member (14) at said fixing end (12*b*).

10. The device (1) according to claim 1, wherein said contact changing member (12) is designed to stay substantially undeformed during operation of said user control (8).

11. The device (1) according to claim 1, wherein the hearing device (1) comprises a housing (3), said battery door (20), and said user control (8), wherein said battery door (20) comprises a lever, and said user control (8) does not comprise a lever.

12. A hearing device (1) comprising
a battery door (20);
a connector (2) having N≧1 electrical contacts (6); and
a user control (8);
wherein said user control (8) comprising:
a) an elastic actuation member (14); and operationally connected thereto
b) a contact changing member (12), which can be different from or identical with said elastic actuation member (14); and operationally connected thereto
c) at least one of said N electrical contacts (6);
wherein at least a portion of said elastic actuation member (14) forms at least a portion of said battery door (20), wherein said battery door (20) has an opening, said elastic actuation member (14) having a waist (14*a*) and being attached to said battery door (20), said waist (14*a*) located within said opening.

13. A hearing device (1) comprising
a battery door (20);
a connector (2) having N≧1 electrical contacts (6); and
a user control (8);
wherein said user control (8) comprising:
a) an elastic actuation member (14); and operationally connected thereto
b) a contact changing member (12), which can be different from or identical with said elastic actuation member (14); and operationally connected thereto
c) at least one of said N electrical contacts (6);
wherein at least a portion of said elastic actuation member (14) forms at least a portion of said battery door (20), wherein said contact changing member (12) is a piece of metal generally extending along an axis (A), said axis (A) being substantially identical with an axis along which said contact changing member (12) is moved when said user control (8) is operated, and wherein said contact changing member (12) has an acting end (12*a*) and, at the contact changing member's opposite end, a fixing end (12*b*), said acting end being arranged—along said axis (A)—below said fixing end and closer to said at least one electrical contact (6).

14. A method of operating a hearing device (1) comprising a battery door (20), a connector (2) with N≧1 electrical contacts (6), and a user control (8), said method comprising the step of using at least one of said N electrical contacts (6) of said connector (2) as a part of said user control (8);

said user control (8) comprising:

a) an elastic actuation member (14); and operationally connected thereto b) a contact changing member (12), which can be different from or identical with said elastic actuation member (14); and operationally connected thereto c) said at least one electrical contact (6);

wherein at least a portion of said elastic actuation member (14) forms at least a portion of said battery door (20)

when said battery door (20) is open and a plug (4) is connected to said connector (2): transmitting information in electrical form to or from said hearing device (1) via said at least one electrical contact (6) and said plug (4); and when said battery door (20) is closed: using said at least one electrical contact (6) in the operation of said user control (8).

15. The method according to claim 14, wherein said elastic actuation member (14) is integrally formed, and said contact changing member (12) is integrally formed.

16. The method according to claim 14 or claim 15, comprising the step of operating said user control (8) by elastically deforming said elastic actuation member (14), thereby causing a change in shape and/or location of said contact changing member (12), thereby causing a change in the state of contacting of said at least one electrical contact (6).

17. The method according to claim 14, comprising the step of changing the state of contacting of said at least one electrical contact (6) by means of said contact changing member (12) by at least one of the following:

establishing an electrical connection between said at least one electrical contact (6) and another electrical contact;

interrupting an electrical connection between said at least one electrical contact (6) and another electrical contact;

increasing resistance between said at least one electrical contact (6) and another electrical contact;

decreasing resistance between said at least one electrical contact (6) and another electrical contact.

18. The method according to claim 14, wherein said user control (8) is a pushbutton, and wherein operating said user control (8) comprises pushing said pushbutton.

19. The method according to claim 14, wherein said user control (8) is integrated in said hearing device (1) during normal operation of the hearing device.

20. The method according to claim 14, wherein said contact changing member (12) comprises a shorting member, said method comprising the steps of establishing an electrical connection between at least two of said N electrical contacts (6) of said connector (2) by operating said user control (8), which operating causes said shorting member (12) to electrically connect said at least two electrical contacts (6) with each other; and detecting said establishment of said electrical connection.

21. Use of at least one of N≧1 electrical contacts (6) of a connector (2) of a hearing device (1) as at least one electrical contact (6) of a user control (8) of said hearing device (1), wherein said hearing device (1) comprises a battery door (20), and wherein said user control (8) consists of a) an elastic actuation member (14); and operationally connected thereto b) a contact changing member (12), which can be different from or identical with said elastic actuation member (14); and operationally connected thereto c) said at least one electrical contact (6);

wherein at least a portion of said elastic actuation member (14) forms at least a portion of said battery door (20).

* * * * *